United States Patent [19]

Deike

[11] 4,050,526

[45] Sept. 27, 1977

[54] POST DRIVING MACHINE

[75] Inventor: Robert F. Deike, Cheyenne, Wyo.

[73] Assignee: Foresight Industries, Cheyenne, Wyo.

[21] Appl. No.: 575,462

[22] Filed: May 7, 1975

[51] Int. Cl.[2] ..... E21C 11/02

[52] U.S. Cl. ..... 173/27; 173/28; 173/43; 173/115; 173/119; 173/133; 173/147; 91/414

[58] Field of Search ..... 173/28, 43, 27, 119, 173/115, 128, 147, 126, 133, 132, 131

[56] References Cited

U.S. PATENT DOCUMENTS

| | | | |
|---|---|---|---|
| 1,800,727 | 4/1931 | Harter | 173/112 |
| 2,655,006 | 10/1953 | Hoen et al. | 173/112 X |
| 2,776,114 | 1/1957 | Brown | 173/31 |
| 3,139,944 | 7/1964 | Smith | 173/119 |
| 3,244,241 | 4/1966 | Ferwerda | 173/139 |
| 3,302,731 | 2/1967 | Perry | 173/43 |
| 3,308,897 | 3/1967 | Becker | 173/130 |
| 3,507,338 | 4/1970 | McWaters et al. | 173/28 |
| 3,525,404 | 8/1970 | Newman et al. | 173/28 X |
| 3,605,912 | 9/1971 | Fisher | 173/115 X |
| 3,696,625 | 10/1972 | Alexander | 173/27 |
| 3,741,072 | 6/1973 | Romell et al. | 91/290 |
| 3,827,507 | 8/1974 | Lance | 173/15 |

*Primary Examiner*—Ernest R. Purser
*Assistant Examiner*—William F. Pate, III
*Attorney, Agent, or Firm*—Hill, Gross, Simpson, Van Santen, Steadman, Chiara & Simpson

[57] ABSTRACT

A portable hydraulic actuated machine for driving posts, ground anchors, concrete breakers, core drills and the like work pieces into the ground, pavements, or wall structures, maintains a continuing thrust on the work piece amplified by sequential hammer blows of controlled magnitude to advance the work piece at a rapid rate without damage to the impact receiving end of the work piece. The machine includes an automotive vehicle which is easily transported to the work site and which carries a turntable supporting an upstanding tower on which rides a carriage slidably mounting a spring loaded heavy hammer, a work piece engaging spring loaded anvil struck by the hammer and hydraulical hammer lifting mechanism. The tower is easily raised and lowered, adjusted toward and away from the vehicle and tiltable laterally to present the hammer and anvil to the work piece at the exact desired location in the plane of the work piece. The carriage is downwardly loaded to compress the anvil spring for exerting a continuing thrust on the work piece.

16 Claims, 11 Drawing Figures

POST DRIVING MACHINE

BACKGROUND OF THE INVENTION

Field of the Invention

This invention relates to a post driving machine and particularly to vehicle mounted hydraulically controlled impacting machines for driving work pieces into solid material.

SUMMARY OF THE INVENTION

According to this invention an automotive vehicle such as a conventional flat bed truck has a turntable mounted thereon for rotation about a vertical axis and an upstanding elongated tower is suspended from this turntable to clear the sides and one end of the vehicle. A carriage rides along the length of this elongated tower and carries an elongated barrel which slidably supports a heavy elongated hammer and has a spring loaded anvil slidably mounted on the end thereof. A hydraulic motor drives the carriage to load the anvil on a work piece and compress the anvil spring for exerting a driving thrust on the work piece. The carriage also supports a spring impelled actuating arm for the hammer, a hydraulic ram for swinging the arm to load the spring and trip mechanism for quickly dumping fluid from the ram so that the spring and gravity will impell the hammer against the anvil. Hydraulic mechanism is provided for positioning the tower at the work site without moving the vehicle and for tilting the tower so that the hammer will be guided to deliver its impact blow in the desired plane. The truck is provided with outriggers to rigidify the turntable support and is also provided with hydraulic jacks to lock out the wheel suspension of the truck and hold the truck bed in a fixed plane.

A feature of the invention resides in a hydraulic system powered from a truck engine driven pump and having easily accessible control for the turntable, the tower positioning mechanism, the carriage loading mechanism, the hammer lift arm mechanism, the outriggers, and the wheel suspension locking mechanism.

While the invention will be referred to as a hydraulic post driving machine it will be understood that this designation encompasses machines for driving concrete breakers, core drills, ground anchors, sign structures, swage tools and that the term "work piece" as used herein includes all such members and devices.

It is then an object of this invention to provide a hydraulic post driving machine that is easily mounted on a standard truck frame and actuated by a hydraulic system powered from the pump engine.

Another object of this invention is to provide a post driving machine which preloads a work piece to be driven and then sequentially augments the preload with hammer blows of controlled magnitude.

Still a further object of this invention is to provide a truck mounted hydraulic post driving machine with a spring loaded work piece engaging anvil, a spring impelled heavy hammer for striking the anvil, and a hydraulic lift for the hammer.

Another object of the invention is to provide a post driving machine with an anvil that never leaves the working face of the work piece to be driven and a hammer striking the anvil which is controlled from an operating panel positioned to provide continual visual inspection of the work pieces being driven.

Another object of the invention is to provide a truck mounted post driving machine with a hydraulic control system that will project, swing and tilt a carriage supporting tower, load the carriage to exert a continuous load on the work piece and control the driving magnitude and sequence of a hammer.

A specific object of the invention is to provide a truck mounted post driving machine with a turntable, a tower supported from the turntable to project, swing and tilt relative to the truck and having a carriage driven along the length of the tower supporting a hammer, a driving mechanism for the hammer and an anvil.

Other and further objects of this invention will become apparent to those skilled in this art from the following detailed description of the annexed sheets of drawings which, by way of a preferred embodiment, illustrate one example of the invention.

ON THE DRAWINGS

BRIEF DESCRIPTION OF THE ILLUSTRATED EMBODIMENTS OF THE INVENTION

THE MACHINE IN GENERAL

Figure 1:
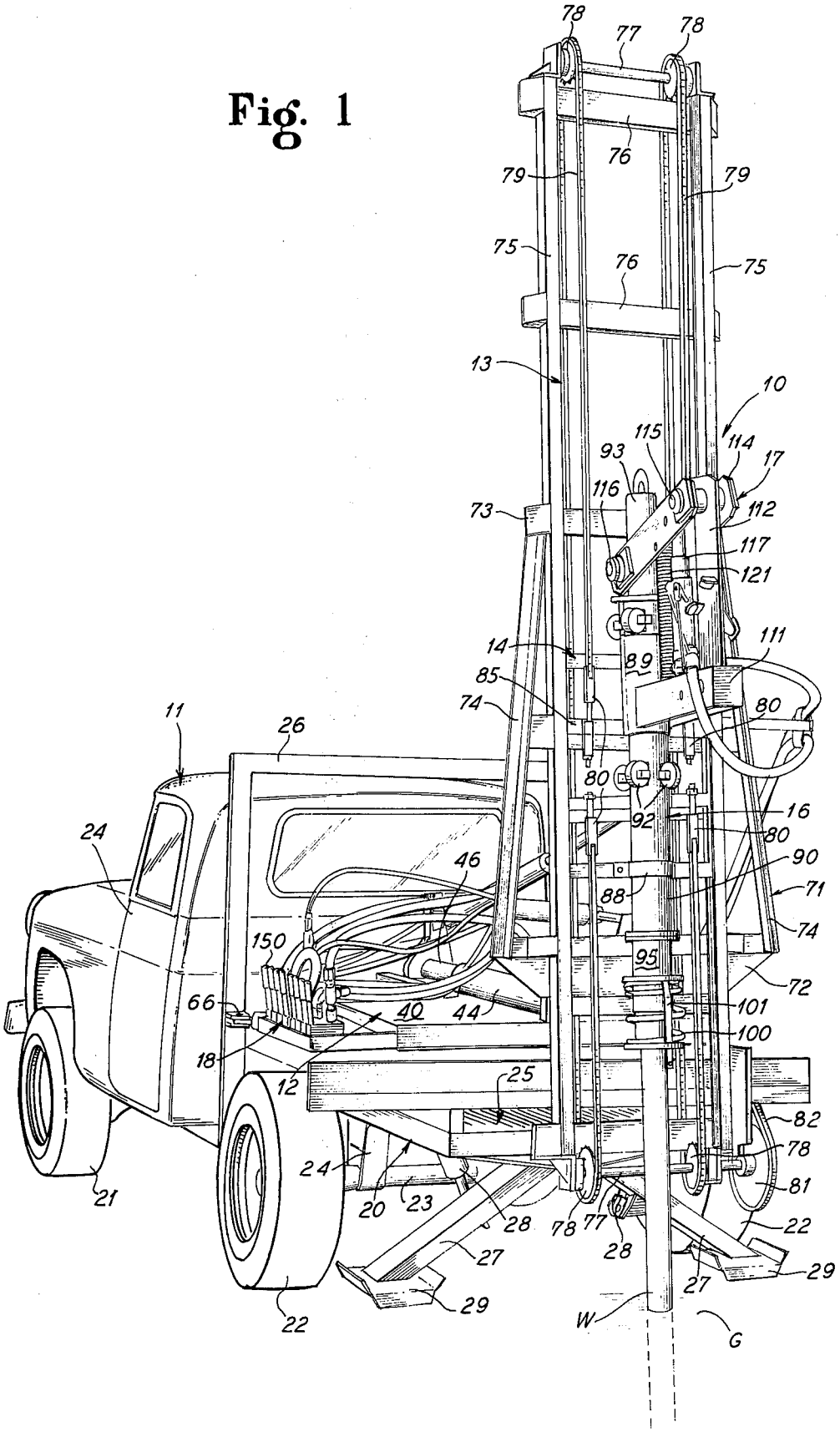
FIG. 1 is a perspective illustration of the post driving machine of this invention viewed from the rear and side.

As shown in FIG. 1 the post driving machine 10 includes an automotive vehicle 11, a turntable tower mounting mechanism 12 supported on the frame of the vehicle 11, an elongated tower 13 carried by the turntable mechanism 12, a carriage 14 riding along the length of the tower 13, a hammer housing and anvil support 16 carried by the carriage 14, a hammer lifting mechanism 17 carried by the housing 16, and a hydraulic control system 18 for the entire machine.

THE VEHICLE 11

The vehicle 11 may be a conventional ¾ or 1 ton truck with a main frame 20 supported on conventional front wheels 21 and rear wheels 22. The rear wheels are mounted on a driving axle 23 connected to the frame 20 by springs 24. A conventional drivers cab 25 is carried by the frame and a flat bed 25 projects rearwardly from the cab 24. A U-shaped frame 26, similar to a roll bar is mounted on the main frame 20 immediately behind the cab 24 and projects above the cab roof to provide a support for the tower 13 when it is lowered to a non-use position for transportion.

Outriggers 27 are suspended from the rear end of the frame 20 and are powered by hydraulic jacks 28 to press ground engaging feet or pads 29 against the ground rearwardly of the wheels 22 for rigidifying the frame 20 and preventing tilting of the truck from the post driving equipment carried thereby.

Figure 10:
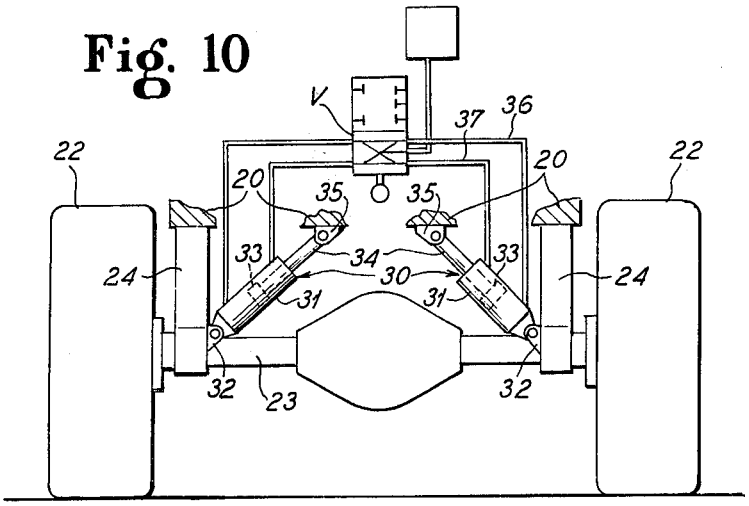
FIG. 10 is a rear end elevational view diagrammatically showing the hydraulic locking system for the truck wheel suspension.

As shown in FIG. 10 hydraulic jacks 30 have their cylinders 31 pivotally mounted on brackets 32 on the rear axle 23 immediately adjacent the springs 24. Pistons 33 in the cylinders 31 have piston rods 34 projecting from the top ends of the cylinders 31. Brackets 35 pivotally mount the ends of these rods 34 to the frame 20.

The interiors of the cylinders 31 below the pistons 33 are cross connected by tubing 36 while tubing 37 cross connects the spaces in the cylinders 31 above the pistons 33. Fluid can thus flow between the cylinders allowing the pistons to assume positions determined by the spring deflections 24. Thus in the event the truck rear wheels 22 assume different levels due to ground contour when the truck is backed into the work site the effective lengths of the hydraulic jacks 30 will extend or contract to accomodate the different levels of the wheels. The springs 24 of course, will deflect to accommodate the wheel levels and to then lock out any deflection of the frame 20 relative to the wheeels, valves V in the tube lines 36 and 37 are closed thereby blocking the pistons 33 in their respective positions in the cylinders 31. The control mechanism for the fluid in the tubing 36 and 37 will be described hereinafter.

THE TURNTABLE MOUNTING MECHANISM 12

Figure 2:
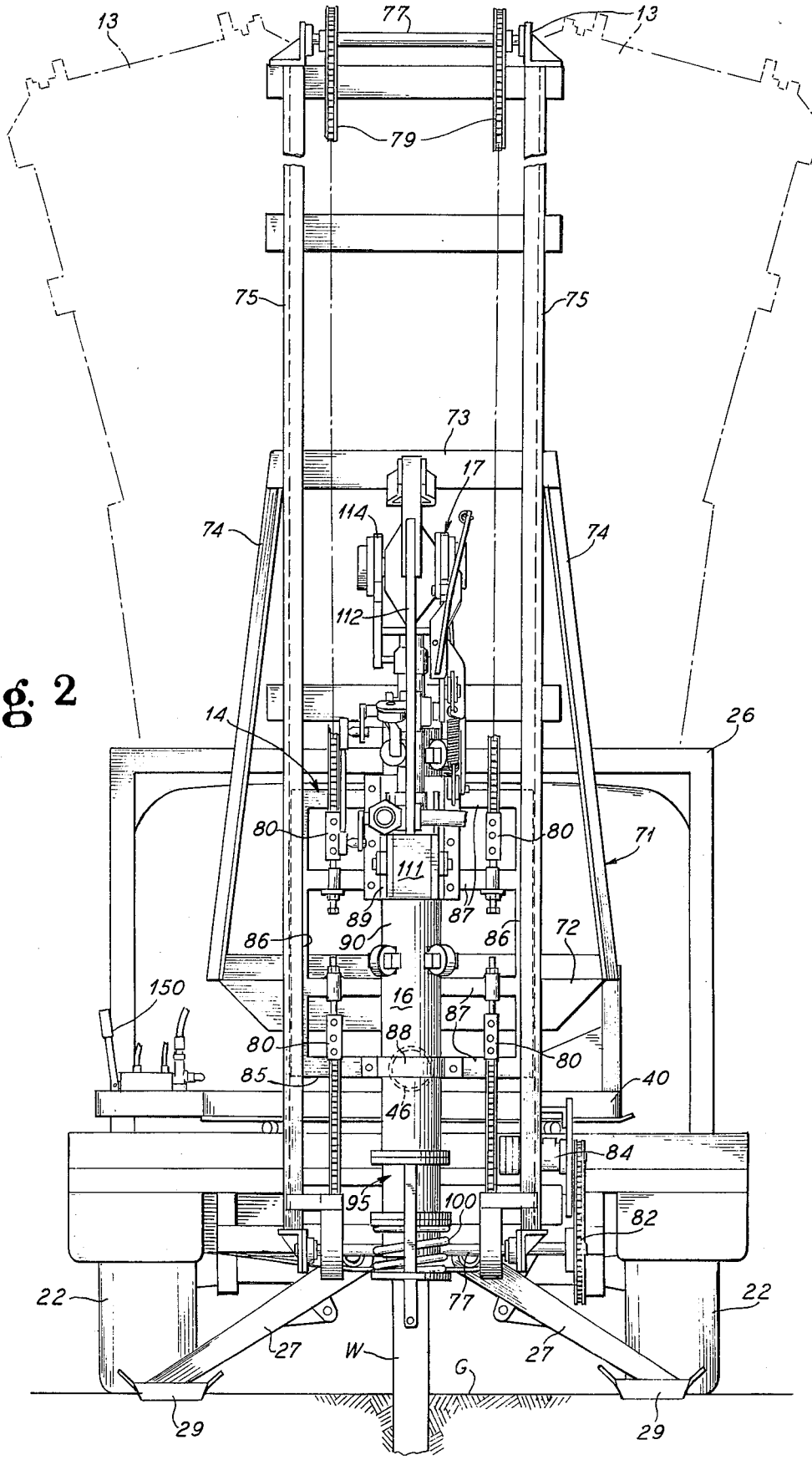
FIG. 2 is a rear end elevational view of the post driving machine showing in dotted lines the tilting of the tower.
Figure 3:
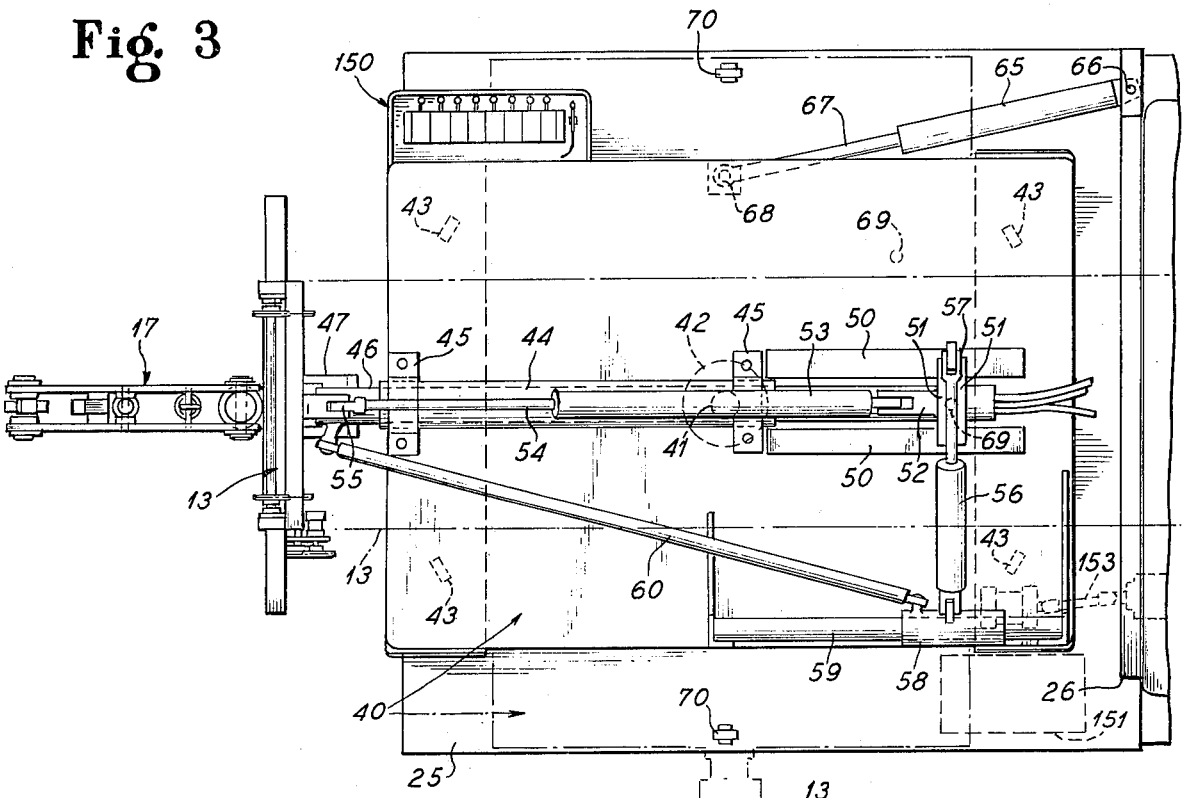
FIG. 3 is a fragmentary top plan view of the turntable and tower assembly.
Figure 4:
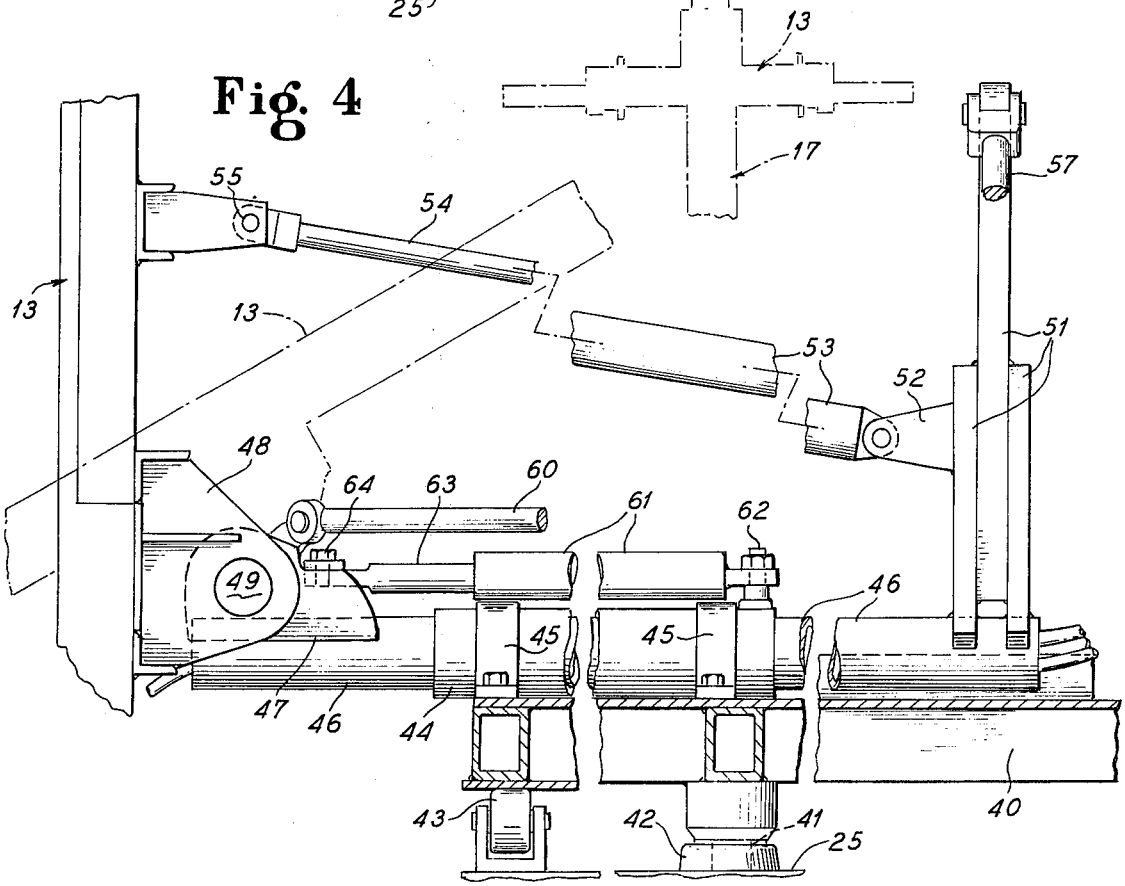
FIG. 4 is a fragmentary, broken, elevational view, with parts in vertical section, of the turntable and tower mounting mechanism.

As shown in FIGS. 1 to 4 a flat rectangular turntable 40 is rotatably mounted above the bed 25 of the truck on a vertical pivot 41 supported in a bearing 42 on the bed 25 as shown in FIG. 4. Rollers 43 are mounted on the bed 25 adjacent the corners of the turntable 40 so that the peripheral underface of the turntable will ride on these rollers.

A heavy tubular sleeve or housing 44 is fixedly mounted horizontally on top of the turntable 40 along the longitudinal axis thereof and is secured to the plate by straps 45. A second tube or post 46 is slidable through the tube or sleeve 44 to project rearwardly beyond the truck bed 25. A bracket mounting 47 on the rear end of the tube 46 cooperates with a bracket 48 on the rear bottom end of the tower 13 while a pivot pin 49 pivotally connects the two pairs of brackets for mounting the tower on the hollow tube or post 46. This pivot mounting permits the tower to swing from an upright position shown in FIG. 1 to a lowered inclined position shown in dotted lines in FIG. 4.

Guide blocks 50 are mounted on the turntable 40 and are adapted to receive the tube or post 46 therebetween as it projects forwardly beyond the housing 44. Th rear end of this tube has bracket plates 51 welded and projecting upwardly therefrom and bracket arms 52 from these plates 51 pivotally support the cylinder end of a hydraulic jack 53 with a piston rod 54 projecting from the other end thereof and pivoted to the tower 13 at 55 to swing the tower about its pivot 49.

A second hydraulic jack 56 has a piston rod 57 pivoted to the bracket plate 51 and has its cylinder pivoted to a sleeve 58 slidably mounted on a rail 59 secured to the turntable. Thus the hydraulic jack 56 can move forwardly and rearwardly with the tube or post 46.

A tie rod 60 is pivotally connected at its ends with the sleeve 58 and the bracket 47.

A hydraulic jack 61, best shown in FIG. 4, has its cylinder end anchored to a pivot stud 62 carried by the turntable 40 while the piston rod 63 of the jack has its end pivoted to a pivot stud 64 on the bracket 47. The jack 61 controls the longitudinal position of the tube or post 46 in the sleeve housing 44 and thus controls the spacing of the tower 30 from the truck bed 25. As the tube 46 is moved into and out of the supporting sleeve 44, the tie rod 60 will propel the sleeve 58 to move therewith and thus the upright position of the tower 13 controlledby the hydraulic jack 53 is not affected.

Another hydraulic jack 65, best shown in FIG. 3, has its cylinder end pivoted at 66 to the base of the support 26 (see also FIG. 1) and has its piston rod 67 pivoted to the turntable at 68. This jack 65 is effective to rotate the turntable 40 about its pivot 41 for rotating the tower 13 from the rear end of the truck to either side of the truck. In order to position the tower alongside the truck without requiring an unduly elongated jack 65, this jack 65 can be sized so that it would rotate the turntable about 45° in either direction from the position shown in FIG. 3 thus moving the tower 13 to the corners of the truck bed 25. Then in order to rotate the tower to the 90° shown in dotted lines in FIG. 3, the pivot connection 68 of the jack 65 is uncoupled and the piston rod 67 is then coupled to an anchor 69 which will, of course, have thus been moved to the dotted line position shown in FIG. 3. Additional rollers 70 are provided on the truck bed 25 for supporting the turntable in its rotated position. These rollers cooperate with the rollers 43 to give rigid supports to the turntable in all of its positions of rotation.

It will thus be understood that the turntable mounting mechanism controls the position of the tower 13 relative to the truck 11 including the upright and lowered position of the tower, the lateral tilting of the tower, the spacing of the tower from the sides and rear end of the truck, and the swinging of the tower from the rear end to both sides of the truck, thus the tower is accurately directed to its operating position without moving the truck.

THE TOWER 13

As best shown in FIGS. 1 and 2 the tower 13 has a rigid frame 71 with a heavy transverse base 72 carrying the connections to the mounting tube or post 46 and a top transverse beam 73 supported from the base 72 by side beams 74. Rails 75 are mounted in spaced parallel relation on this frame 71 and are rigidly affixed thereto to depend below the frame base 72 and to extend considerably above the cross beam 73 of the frame. The rails are channelled to slidably support the carriage 14.

The top and bottom ends of the tower have bearings rotatably supporting shafts 77 on each of which are mounted sprockets 78 and sprocket chains 79 are trained around these sprockets and anchored at their ends to tightening bolts or turnbuckles 80 on the carriage 13. These turnbuckles are tightened to keep the chains 79 in a taut condition.

The bottom shaft 75 is extended at one end beyond its bearing to mount a sprocket drive wheel 81 on which is trained a chain 82 driven from a smaller sprocket 83 that is powered by a hydraulic motor 84 mounted on the tower frame. This hydraulic motor is effective to raise and lower the carriage 14 along the length of the tower 13 and is also effective to load the carriage downwardly as will be more fully hereinafter described.

From the above description it will be understood that the tower 13 slidably supports the carriage 14 and has drive mechanism to propel the carriage along the length of the tracks of the tower.

THE CARRIAGE 14

The carriage 14 as shown in FIG. 2 has a rigid rectangular frame 85 with side legs 86 sliding in the channels of the tower tracks 75 and cross legs 87 mounting the tightening bolts or turnbuckles 80 for the sprocket chains 79 as well as a mounting bracket or straps 88 and 89 for the hammer housing 16 and the hammer lift mechanism 17.

From this description it will be understood that the carriage 14 provides the supporting base for the hammer housing 16 and the hammer lift mechanism 17.

THE HAMMER HOUSING AND ANVIL SUPPORT 16

As shown in FIGS. 1, 2, and 5 to 8, the hammer housing 16 has an upright rigid open ended sleeve 90 rigidly affixed to the rear face of the carriage 14 by the afore mentioned brackets and straps 88 and 89. The sleeve 90 has circumferentially spaced slots 91 at several levels along its length and these slots receive rollers 92 therethrough which are mounted on brackets stradling the slots. The rollers 92 engage the periphery of a very heavy elongated hammer 93 to mount the hammer for free longitudinal movement in the sleeve 90. The hammer projects above the top of the sleeve 90 to be engaged by an arm of the lifting mechanism 17 and has a bottom striking end 94 retracted into the sleeve 90 for a distance controlled by the lift mechanism as hereinafter described.

The bottom end of the sleeve 90 has an anvil device 95 depending therefrom. This device 95 includes a sleeve 96 with outturned flanges 97 adapted to be bolted to mating flanges 98 on the bottom of the sleeve 90 and 99 adapted to bottom a compression spring 100. Rods 101 secured on the top flange 97 of the sleeve 96 depend therefrom beyond the bottom of the sleeve 96 and have stops 102 on their free ends thereof. A sleeve 103 has a bottom flange 104 slidably receiving these rods 101 therethrough. The sleeve 103 projects into the bottom of the housing sleeve 96 and has a heavy anvil head 105 affixed to its top end to provide the anvil striking surface for the striking end 94 of the hammer 93. The compression spring 100, bottomed on the flange 99 of the housing 96 and on the flange 104 of the sleeve 103 biases the anvil head 105 downwardly to the bottom of the housing 96.

Figures 5, 6:
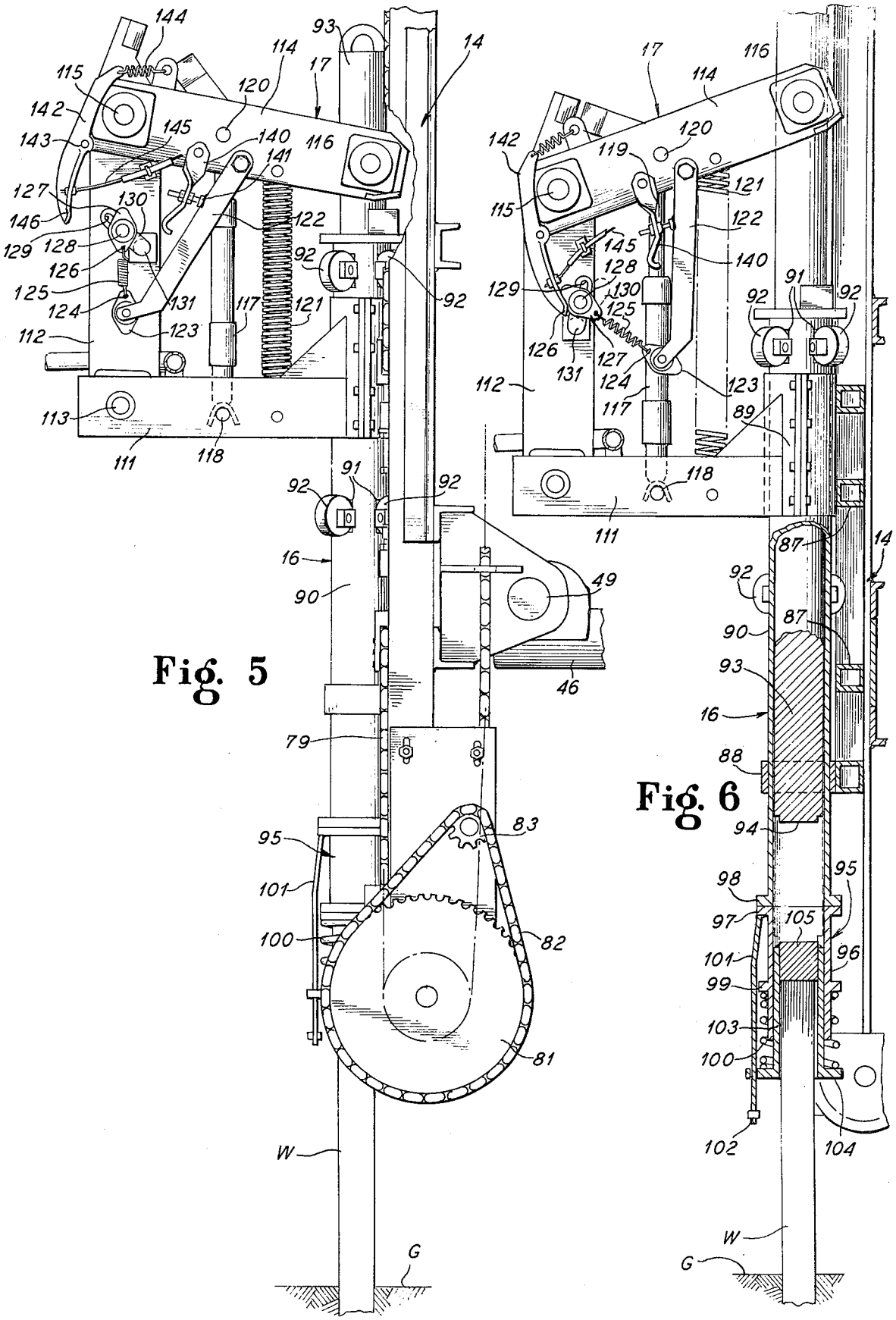
FIG. 5 is a fragmentary side elevational view of the lower end portion of the tower, the tower supported carriage and the carriage mounted hammer mechanism in its impact position.
FIG. 6 is a view similar to FIG. 5, with parts in vertical section and showing the hammer mechanism in its raised position.
Figure 8:
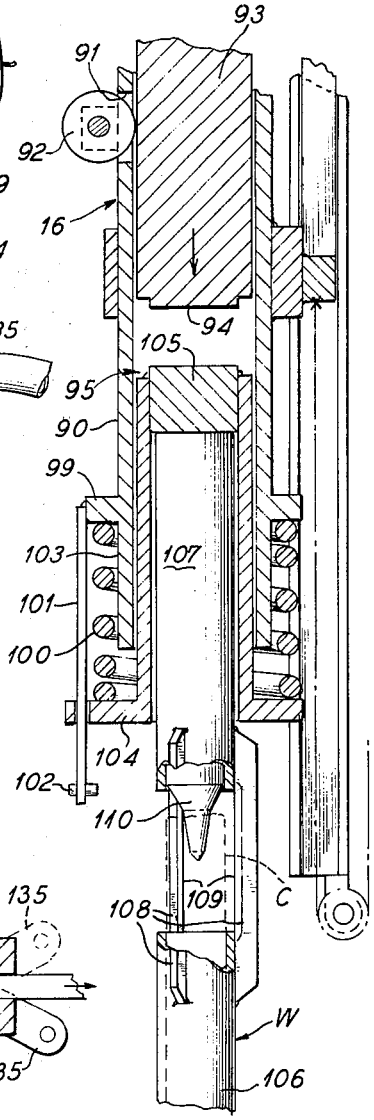
FIG. 8 is a fragmentary vertical sectional view of the anvil and lower end of the hammer with the anvil receiving the working end of a core drilling tool shown partly in elevation and in section.

As shown in FIGS. 1, 2, 5, 6, and 8 the work piece W to be driven into the ground G has its top end received in the anvil assembly 95 and as shown in FIGS. 6 and 8 this top end of the work piece engages the anvil head 105. The work piece W can take any of the forms described hereinabove such as a post, a ground anchor, a core drill or the like. As shown in FIG. 8 the work piece is a core drill including a hallow open ended cylinder 106 suspended from a rodlike head 107 on circumferentially spaced straps 108 welded to the bottom of the head 107 and top of the cylinder 106 and having sharp inner knife edges 109. A piercing nose 110 depends from the head 107 to present a pointed end centrally of the area surrounded by the straps 108. When the cylinder 106 is driven into the ground, a central core C is cut from the ground and extrudes through the cylinder to be engaged by the nose 110 which spreads the core against the knife edges 109 of the straps and disperses the core material to the outside of the assembly The work pieces W engage the anvil head 105 and in the event the work piece has a diameter too large to enter the sleeve 103 for engaging this anvil 105, the sleeve can receive a spacer rod resting on the anvil head 105 and projecting beyond the sleeve to engage the end of the work piece.

In operation the carriage 14 is powered downwardly by the hydraulic motor 84 to thrust the anvil head 105 against the top of the work piece and to compress the spring 100 thereby providing a continuing downward thrust load on the work piece.

From the above descriptions it will therefore be understood that the hammer 93 is freely slidable in the housing 16 and that this housing suspends a spring loaded anvil which is constantly pressed against the work piece to be driven by the hammer.

THE HAMMER LIFTING MECHANISM 17

As shown in FIGS. 1 and 5 to 8 the hammer lifting mechanism 17 includes a base arm 111 rigidly affixed to the carriage bracket 89 and extending rearwardly therefrom. An upright link arm 112 is pivoted at its bottom end to the rearmost end of the arm 111 by a pivot pin 113. A lift arm 114 is pivoted at 115 to the upper end of the arm 112 and extends forwardly therefrom to stradle the upper end of the hammer 93 and is pivotally pinned to the hammer at 116.

A hydraulic jack 117 has the lower end of its cylinder pivoted at 118 to the support arm 111 and has its piston rod 119 pivoted at 120 to an intermediate portion of the arm assembly 114. The ram 117 is adapted to swing the arm 114 about its pivot connection 115 to the arm 112.

Figure 7:
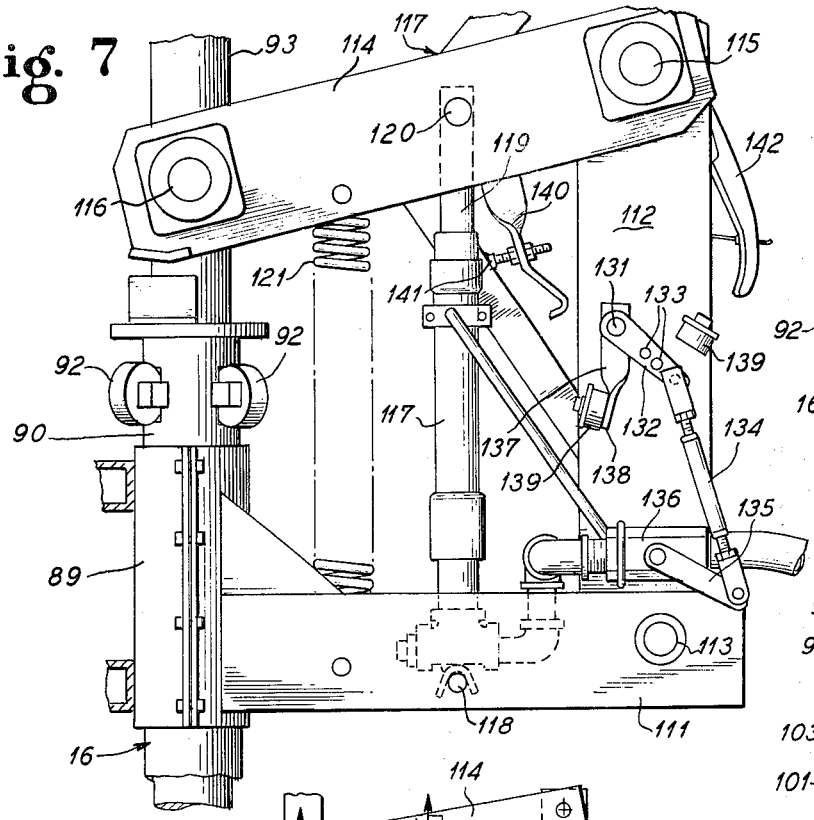
FIG. 7 is a side elevational view of the side of the hammer lifting mechanism opposite the side shown in FIGS. 5 and 6.

A tension spring 121 is anchored at its ends to the arms 111 and 114 inwardly from the ram 117 and is effective to pull the arm 114 downwardly toward the arm 111. The stroke and timing of the hammer 93 is effected by pumping hydraulic fluid into the ram 117 for raising the piston rod 119 and thereby lifting the arm 114 which, of course, raises the hammer 93 and stretches the spring 121. Then a toggle mechanism controlled through a Bowden wire connection at the control station 18 of the hydraulic system effects a rapid opening of a dump valve for the hydraulic fluid releasing it from the ram 117 and allowing the spring 121 to propel the lift arm 114 and hammer 93 downwardly against the anvil head 105. This toggle control mechanism includes an arm 122 fixedly bolted to the lift arm 114 intermediate its ends and depending therefrom, as shown in FIGS. 5 and 6 to pivotally support an oval shaped spring anchor 123. This anchor 123 is free to rotate on the end of the arm 122 and has an aperture 124 at the end of one of its long lobes in which is anchored a tension spring 125. The other end of the tension spring 125 is anchored in an aperture 126 of a similar oval shaped member 127 that is rotatably mounted on a pin 128 adjustably locked in the slot 129 of a link arm 130 carried on a rotatable shaft 131 mounted in the arm 112. This shaft 131 as shown in FIG. 7 extends through the arm 112 and has its other end secured to a link arm 132 with a plurality of mounting holes 133 for one end of a link 134, the other end of which is pivotally connected to a control arm 135 of a dump valve 136 feeding the ram 117. The shaft 131 also has affixed thereto, behind the arm 132, a finger 137 with a striking end face 138 adapted to engage resilient bumper pads 139 mounted on the arm 112.

Another finger 140 depends from the arm 114 and slidably receives an adjustable stop screw 141 anchored on the arm 112. Nuts on this screw adjust the finger relation to the arm for positioning its striking end.

The arm 130, shaft 313, and arm 132 provide a bell crank which is spring loaded by the spring 125 to snap from the position of the arm 130 shown in FIG. 5 to the dotted line position of the arm 130 shown in FIG. 6. In the FIG. 5 position the bell crank has lifted the arm 132 shown in FIG. 7 to a position closing the valve 136 and admitting fluid to the arm 117. This, of course, will force the piston rod 119 out of the ram cylinder lifting the arm 114 to the position shown in FIG. 6 where the spring 125 has been pulled by the arm 122 to a position that will snap the arm 130 from the FIG. 5 position to the dotted line position of FIG. 6 and this shifts the valve 136 to a dump position releasing fluid from the ram 117 and permitting the spring 121 and weight of the hammer 93 to impact the hammer against the anvil. It will be understood that the shifting of the spring anchor 124 by the arm 122 as it is raised from the FIG. 5 to the FIG. 6 position will provide an over-center loading that will snap the arm 130 from a closed valve position to an open dump valve position. Then as the lift arm 114 drops from the FIG. 6 position back to the FIG. 5 position, the striking end of the finger 140 will engage the lever 130 to snap it back to the FIG. 5 position. A toggle or over-center arrangement is thus provided to control the valve for the ram 117 thereby controlling the raising and lowering of the lift arm 114.

Now if it is desired to alter the stroke of the hammer 93 from the sequence determined by the over-center spring arrangement 125, a rocker arm 142 pivoted at 143 on the rear end of the lift arm 114 and biased by a spring 144 away from the lever 130 of the bell crank, is controlled by a Bowden wire 145 extending from the control station for the hydraulic system to position a striking end 146 of the rocker arm relative to the oval shaped member 127. This striking end can then be positioned so as to exert a lifting action on the member 127 as shown in FIG. 6 to cause it to swing the lever 130 to the dotted line position. The Bowden wire control thus modifies or alters the stroke of the hammer as desired by the operator.

Figure 9:
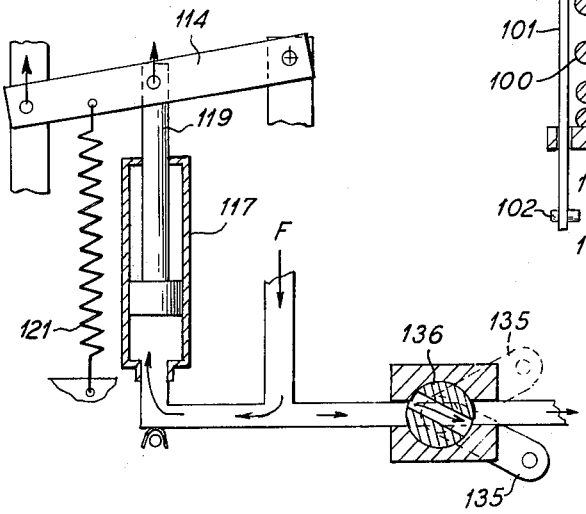
FIG. 9 is a fragmentary diagrammatic view of the hydraulic system for the hammer lift mechanism.

As shown in FIG. 9 the valve 136 is shiftable from an open position that will dump fluid from the ram 117 even though fluid F is continued to be supplied to the feed line to the ram. When the valve 136 is closed this fluid will, of course, raise the piston rod 119 of the ram 117 to raise the lift arm 114 but when the valve is open the dumping capacity is greater than the intake flow so that the fluid will be released from the ram.

From this description it should be understood that the lifting arm 114 is pivotally carried on a member which is also pivotally supported from a base and is propelled in a lifting direction by a hydraulic jack 117 and in a downward striking direction by a spring 121. A toggle control, adjustable from a control station through a Bowden wire dumps the hydraulic fluid from the lifting jack at the top of a lifting stroke and feeds hydraulic fluid back to the lifting jack immediately after impact of the hammer against the anvil. The toggle arrangement operates with a snap action to actuate the dump valve rapidly and the bumpers 139 protect against damage.

THE HYDRAULIC CONTROL SYSTEM 18

Figure 11:
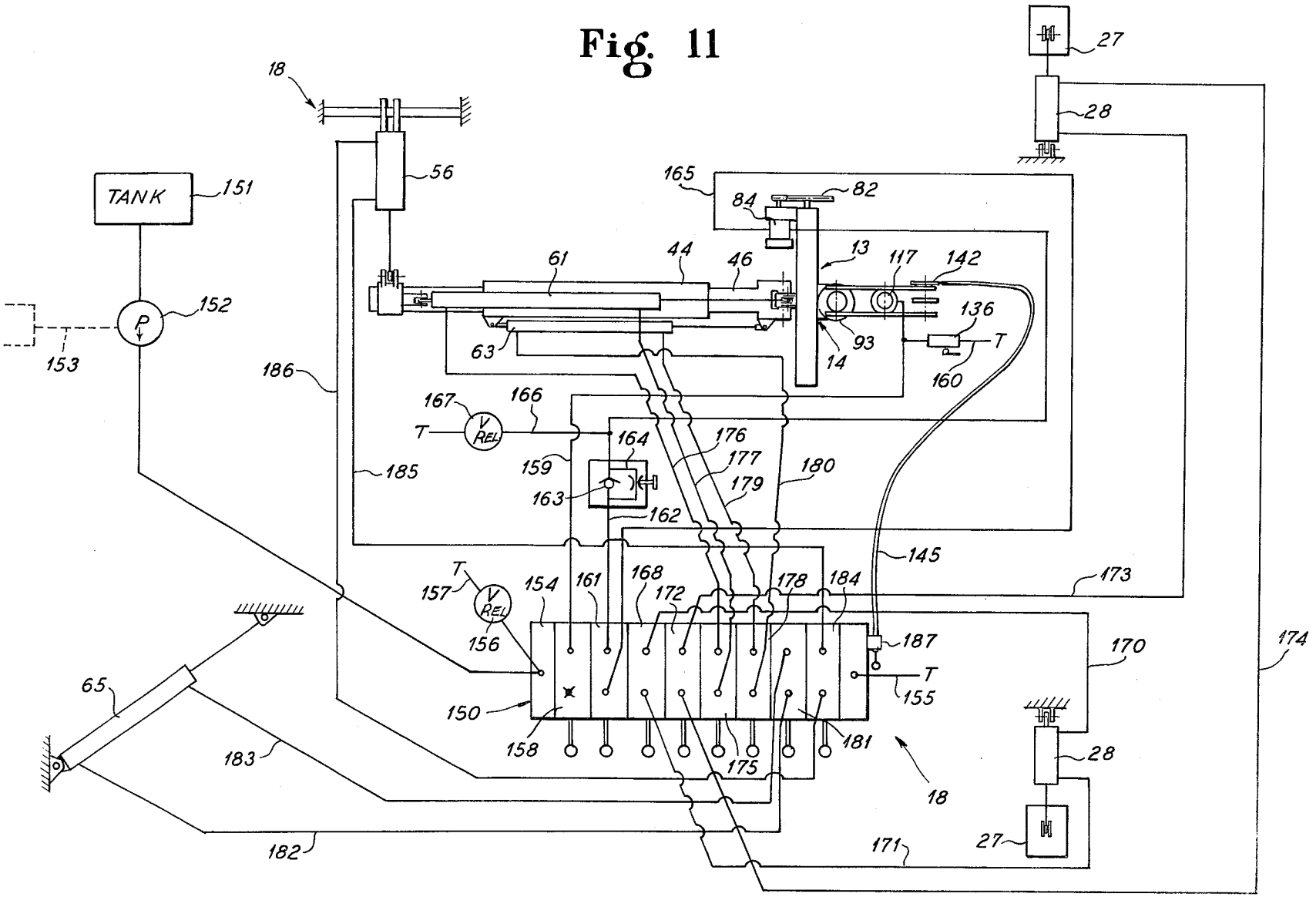
FIG. 11 is a diagrammatic view of the hydraulic control system for the post driving machine.

As shown in FIGS. 1, 3 and 11 the hydraulic control system 18 includes a valve control back 150 which is conveniently mounted on the turntable 12 along the left rear side thereof as viewed in FIG. 1. This location of the valve bank is convenient for giving the operator a full view of the mechanisms being controlled.

As shown in FIG. 11 a hydraulic fluid supply tank 151 feed a pump 152 driven from a power take-off 153 of the truck engine (not shown). The pump 152 feeds pressured hydraulic fluid to a manifold 154 of the valve bank 150. The manifold 154, when all of the valves in the bank are open feeds freely back to the tank as indicated by the return line 155. When one of the valves in the bank is closed the manifold 154 is maintained under a pressure determined by a relief valve 156 which, when open, returns fluid through the line 157 back to the tank 151.

A first valve 158 in the valve bank 150 supplies pressurized fluid throuogh a line 159 to the hammer lifting jack 117. As shown the dumping valve 136 leads from this supply line 159 to dump the pressurized fluid back to the tank through line 160. Thus when valve 158 is opened the line 159 is continually pressured but the lifting ram 117 is only actuated when the valve 136 is moved to a position to cut down the feed back to the tank through the valve 136 and at all times the valve 136 is set so as there is some bleed back from the line 159 to the tank 151. This prevents any reversal of flow in the line 159.

A second valve 161 feeds a supply line 162 containing a check valve 163 and an adjustable restriction bypass 164. The line 162 beyond the check valve feeds the motor 84 to rotate it in a direction for lowering the carriage. The driving fluid flows through the motor and is discharged through a line 165 back to the valve 161 which will then be in a position to feed the fluid back to the discharge line 155 of the valve bank manifold. However, the valve 161 can be reversed to feed the pressurized fluid through the line 165 thereby driving the motor 84 to raise the carriage. In order to maintain a downward thrust on the carriage for compressing the spring 100 to hold the anvil head 105 against the work piece, the line 162, beyond the check valve 163 and adjustable bypass 164 is vented back to the tank through a line 166 containing a pressure relief valve 167. Thus the line 162 will be held at a pressure of say, about, 400 P.S.I. and the check valve 163 will prevent back flow in this line to the valve 161. When the line 165 is pressured to drive the motor 184 in a direction for lifting the carriage 14, the bypass valve 164 is opened to relieve the back pressure load on the line 162 thereby dumping the fluid back to the manifold through the valve 161.

The next valve 168 in the valve bank feeds lines 170 and 171 to opposite sides of the piston in the one jack 28 of one of the outriggers 27 while the next valve 172 feed lines 173 and 174 to the opposite sides of the piston in the other outrigger jack 28. These lines accommodate reverse flow so that when the jacks 28 are pressured upwardly the fluid above the pistons in the jacks will flow freely back through the valves to the outlet 155.

The next valve 175 supplies the pressure fluid to opposite sides of the piston in the cylinder 61 through lines 176 and 177.

The next valve 178 supplied fluid to opposite sides of the piston in the jack 63 through supply lines 179 and 180.

The following valve 181 supplies fluid to the opposite sides of the jack 65 through lines 182 and 183.

The valve 184 supplied fluid to the opposite sides of the piston in the jack 56 through lines 185 and 186.

The valves 158, 161, 168, 172, 175, 178, 181 and 184 are each equipped with operating handles convenient to the operator and it will be understood that the arrangement of valves can be varied considerably without departing from this invention.

As shown, the valve bank 150 can also mount a control lever 187 for the Bowden wire 145 controlling the position of the rocker arm 142 to thereby control the stroke of the hammer 93 as described hereinabove.

OPERATION OF THE MACHINE

The portable machine 10 of this invention is mounted on a conventional truck and thus can be driven down the highway to be transported rapidly to a work site without requiring additional carrying equipment or trailers. The machine is driven directly to the work site, outriggers are lowered to stablilize the truck frame and the spring suspension of the rear truck wheels is mobilized by cross flow connected jacks which will lock the wheels and frame together in fixed relation accommodating variations in the levels of the rear wheels of the truck due to ground contour while at the same time preventing the truck frame from deflecting under variable loads.

In transporting the machine to the work site, the tower 13 of the machine is in a lowered position resting on a roll bar type support mounted on the truck frame and in this lowered position the tower will fit freely under viaducts and bridges.

When the truck frame is locked in operating position at the work site, the tower is raised by a hydraulic jack to an upright position and is tilted sideways by anoher hydraulic jack to position the impact hammer which is carried by the carriage 14 on the tower in a direction to deliver its thrust impact against the work piece. The tower can also be moved laterally away from the truck frame to position it accurately over the work piece.

The housing for the hammer of the machine mounts a spring loaded anvil and the carriage of the machine is lowered on the tower to rest the anvil on the work piece and is then downwardly pressured to compress a spring on the anvil for exerting a continuous positive down force of 2,000 pounds or greater. This force not only maintains the anvil in constant contact with the work piece to prevent peening of the work piece by the hammer but also assists the hammer in driving the work piece into the ground.

The hammer is quite heavy and when dropped on the anvil will deliver a heavy impact blow to drive the work piece into the ground. In addition, however, the hammer is propelled by a tensioned spring which is stretched by a lifting jack that also raises the hammer and determines the length of the stroke. This lifting jack is continuously supplied with fluid from a pump source on the truck and the fluid is continually bled from the jack at a rate controlled by a valve which is operated from a toggle tripping device to dump the fluid from the valve at the end of the lifting stroke thereby permitting the hammer to fall free and the spring to propel the hammer against the anvil. The impact of the hammer against the anvil advances the work piece into the ground and the compressed anvil spring will cause the anvil to follow the work piece. However, as soon as the spring expands to follow the work piece a hydraulic motor drives the carriage to follow up the anvil and again compress the spring to continue the thrusting force against the work piece.

All of the operations of the machine are controlled from a single bank of valves convenient to an operator standing alongside of the machine where he can view all of the operations. The stroke of the machine is controlled from this central bank of valves by a Bowden wire which regulates the position of a rocker arm controlling the tripping of the toggle mechanism for regulating the filling and dumping of the hydraulic fluid in the hammer raising jack.

The machine is also useful to pull posts and other work pieces out of the ground and for this puropse a post engaging vise or chain lift can be lifted by the hammer lifting jack as for example by disconnecting the hammer pivot 116 and anchoring the lifting member to the arm 114. A retraction or lifting force of 3,000 pounds can be delivered from a machine 10 of this invention mounted on a ¾ ton truck.

From the above descriptions it should, therefore, be clearly understood that this invention provides an easily transportable hydraulic post driving machine which is easily and quickly mounted in driving position and easily operated by a convenient hydraulic control.

I Claim As My Invention:

1. A mobile hydraulic driving machine exerting a continuous driving force on a work piece amplified by intermittent hammer blows of controlled magnitude on the work piece which comprises an automotive vehicle, a turntable rotatably mounted on the vehicle, an elongated tower mounted on said turntable, hydraulic means for raising and lowering said tower from an upright position to a substantially horizontal inclined position, means on said vehicle supporting the tower in its lowered position, hydraulic means tilting said tower sideways, hydraulic means positioning said tower relative to said vehicle, a carriage riding on said tower along the length thereof, hydraulic means driving said carriage and effective to power the carriage downwardly to exert a thrusting action on a work piece, a hammer slidably supported by said carriage, an anvil carried from the carriage adapted to be struck by said hammer, a spring acting on said anvil compressed by a downward thrust load on the carriage to hold the anvil against a work piece and to cause the anvil to follow the work piece as it is impacted by the hammer, hydraulic means for lifting said hammer, tension spring means stretched by said hydraulic means for propelling said hammer against the anvil, and means to dump hydraulic fluid from the hydraulic means lifting the hammer and stretching the spring to control the stroke of the hammer.

2. A mobile post driver comprising a movable vehicle, a turntable mounted on said vehicle for rotation about a verticle axis, an upstanding elongated tower suspended from said turntable to clear the sides and one end of the vehicle, a carriage riding on said tower along the length thereof, a hammer slidably suspended from said carriage, a work piece engaging anvil slidably suspended from said carriage in position to be impacted by said hammer, a spring urging said anvil against the work piece, means holding the carrige to compress the spring for continuously thrusting the anvil against the work piece, hydraulic mechanism on the carriage for lifting the hammer, tension spring means on the carriage stretched by said hydraulic mechanism for propelling the hammer against the anvil, means for controlling said hydraulic mechanism to vary the stretching of said tension spring means to change the stroke of said hammer and the impact force of the hammer on the anvil, and hydraulic means for raising and lowering the tower, for rotating the turntable, for spacing the tower relative to the vehicle, and for tilting the tower laterally.

3. A driving and retracting machine which comprises a mobile frame support, a tower adjustably carried by said support, a hammer mounting adjustably carried by said tower, a hammer slidably carried by said hammer mounting, means driving said hammer, a work piece engaging anvil adapted to be struck by said hammer, spring means between the anvil and hammer mounting, and power means loading said hammer mounting for continuously loading said spring means to maintain the anvil against a work piece engaged by the anvil and to cause the anvil to remain in constant engagement with a work piece as the anvil is impacted by said hammer to thereby follow a work piece engaged by the anvil without rebounding from the work piece after it is impacted by said hammer

4. A driving and retracting machine which comprises a mobile supporting platform, a turntable mounted on said platform, hydraulic mechanisms supported by said turntable, a tower mounted on said turntable for adjustment in any direction relative to the turntable, connections from said hydraulic mechanism to said tower controlling the position of the tower relative to the turntable, hydraulic means for rotating said turntable on said platform, a carriage riding on said tower, a hammer support mounted on said carriage, means on said carriage for driving the hammer, including a lift arm pivoted to the hammer, a spring propelling the lift arm in a direction to impact the hammer against the work piece, a hydraulic jack for lifting the lift arm to stretch the spring, an off-center actuated toggle mechanism controlled by the lift arm to regulate hydraulic flow to and from said hydraulic jack, and means on said tower for thrusting the carriage downwardly to exert a thrust load on a work piece to be impacted by the hammer.

5. In a post driving machine having a hammer for delivering impact blows to a work piece to be driven into the ground, the improvements which comprise a tension spring linked to said hammer to provide the sole driving force for propelling said hammer, hydraulic means for loading said spring, a hydraulic circuit feeding hydraulic fluid to said hydraulic means to control loadng and unloadng of said spring, and a manually controlled adjustment means for said hydraulic circuit regulating the dumping of said hydraulic fluid to vary the stroke of said hammer.

6. The machine of claim 1 including a manually controlled adjustment for said means to dump hydraulic fluid to vary the stroke of the hammer.

7. The machine of claim 1 wherein the hydraulic means driving the carriage is a reversable hydraulic motor mounted on the tower.

8. The machine of claim 1 wherein all of said hydraulic means is powered from a pump by the motor of the automotive vehicle.

9. The machine of claim 1 wherein the carriage has an open ended sleeve housing affixed thereto slidably receiving the hammer and slidably supporting the avil.

10. The machine of claim 9 wherein the anvil extends into the lower end of said sleeve and receives the work piece therein.

11. The post driver of claim 2 wherein the means holding the carriage to compress the spring for continuously thrusting the anvil against the work piece is a hydraulic motor on the tower and a chain and sprocket drive connecting the motor with the carriage.

12. The post driver of claim 2 wherein the hydraulic mechanism on the carriage and the hydraulic means are all controlled from a central valve bank mounted on the turntable so that an operator may view all of the operation without visual obstructions.

13. The post driver of claim 2 wherein the turntable mounts a horizonal housing sleeve, a post pinned to the lower end of the tower is slidable in the sleeve, and the hydraulic means for spacing the tower relative to the vehicle is a hydraulic jack sliding said post in said sleeve.

14. The post driver of claim 13 wherein the means for tilting the tower laterally is a second hydraulic jack for rotating said post in said sleeve.

15. The mobile post driver of claim 14 wherein the second hydraulic jack is slidably mounted to follow the post.

16. The machine of claim 4 including a Bowden wire actuated rocker arm on the lift arm for varying the timing of the off-center toggle mechanism.

* * * * *